United States Patent [19]

Spaller, Jr.

[11] Patent Number: 4,716,801

[45] Date of Patent: Jan. 5, 1988

[54] RAPID CUT-OFF APPARATUS FOR HIGH SPEED MOVING YARN

[75] Inventor: Albert E. Spaller, Jr., Johnson City, Tenn.

[73] Assignee: Eastman Kodak Company, Rochester, N.Y.

[21] Appl. No.: 896,692

[22] Filed: Aug. 15, 1986

[51] Int. Cl.[4] ..... B26D 1/62

[52] U.S. Cl. ..... 83/286; 57/86; 83/67; 83/308; 83/346; 83/370; 83/586

[58] Field of Search ..... 83/286, 308, 346, 370, 83/586, 63, 66, 67, 72; 57/86

[56] References Cited

U.S. PATENT DOCUMENTS 2,064,697 12/1936 Smyth ..... 57/86

2,456,406 12/1948 Gordon et al. ..... 57/86

FOREIGN PATENT DOCUMENTS 190009 12/1922 United Kingdom ..... 57/86

*Primary Examiner*—Frank T. Yost

*Attorney, Agent, or Firm*—Thomas R. Savitsky; William P. Heath, Jr.

[57] ABSTRACT

Rapid cut-off apparatus for high speed moving yarn whereupon any excessive force exerted upon the yarn causes the apparatus to be triggered into a yarn cut-off operation with the apparatus being accelerated to the speed of the moving yarn upon frictional engagement of the cut-off blade of the apparatus with the yarn.

4 Claims, 2 Drawing Figures

RAPID CUT-OFF APPARATUS FOR HIGH SPEED MOVING YARN

DESCRIPTION

The present invention is directed to a rapid cut-off apparatus for high speed moving yarn wherein the yarn cut-off operation is accelerated to the speed of the moving yarn upon frictional engagement of the cut-off blade of the apparatus with the yarn.

The present invention is intended as a safety apparatus for use in a thread or yarn operating line employing, for example, a high speed rotating cutter. such as the one disclosed in U.S. Pat. No. 4,519,281. The cut-off apparatus is located upstream, preferably immediately upstream, of the high speed cutter to prevent an operator from being pulled into the high speed cutter should he become entangled in some manner with the thread or yarn. When the thread or yarn in such an operating line is moving at several thousand meters per minute, for example 2,000 meters per minute, it must be appreciated that the thread or yarn is moving at the rate of over 33 meters for each second, a rate humanly impossible to stop by any attempt to cut the power to the high speed cutter and brake its rotation to a stop.

The rapid cut-off apparatus of the present invention also serves another safety purpose: to prevent an undersirable overload and thus damage to operating apparatus such as the high speed cutter disclosed in U.S. Pat. No. 4,519,281, should the thread or yarn suddenly become jammed or otherwise mechanically prevented from moving freely toward the high speed cutter.

DISCLOSURE OF INVENTION

In accordance with the present invention, therefore, I provide a cut-off apparatus for rapidly cutting a yarn moving along a path therepast at high speed toward a yarn processing station when tension upon the yarn exceeds a predetermined tension. The cut-off apparatus comprises a support structure positioned to one side of the path of the high speed moving yarn. An anvil is connected to the support structure and projects therefrom across the yarn path and is spaced from the yarn to provide a cutting surface in alignment with the yarn moving along the path. A cut-off blade structure having a cutting edge projecting therefrom across the yarn path is positioned on the opposite side of the path from the cutting surface of the anvil. The cut-off blade structure is movably connected to the support structure between an inoperative position spaced from the yarn and an operative cut-off position in engagement of the cutting edge against the cutting surface of the anvil. The cutting edge frictionally engages the yarn and forces it against the cutting surface of the anvil to sever it in the course of moving from the inoperative position toward the operative cut-off position. A yarn guide arrangement is movably connected to the support structure between an operative position extending across the path of the yarn for engaging and guiding the yarn toward the aforementioned yarn processing station and to an inoperative non-yarn guiding position away from the yarn path. The yarn guide arrangement is located on the support structure upstream of the path of the yarn from the anvil and the cut-off blade structure. An over-the-center spring arrangement having a predetermined tension is located on the support structure. It is connected at one end to the cut-off blade structure and at its other end to the yarn guide arrangement. The over-the-center spring arrangement is shiftable between (a) a first position for holding the cut-off blade structure in its aforementioned inoperative position and the yarn guide arrangement in its aforementioned operative position and (b) a second position for moving the cut-off blade structure to its aforementioned cut-off position. The yarn guide arrangement is forced by the yarn in engagement therewith to its aforementioned inoperative non-yarn guiding position upon tension on the yarn exceeding the predetermined tension of the over-the-center spring arrangement, and thereby the yarn guiding arrangement shifts the over-the-center spring arrangement to its aforementioned second position in the course of the movement of the yarn guiding arrangement to the inoperative non-yarn guiding position.

The anvil is circular in configuration and is adjustably rotatable to provide the cutting surface in unmarred condition.

The yarn guide arrangement includes a first lever pivotally connected at its one end to the support structure. The first lever has extending from its other end a cylinder defining a yarn guiding surface. The support structure defines a stop surface to be abutted by the cylinder when the yarn guide arrangement is in its operative position.

The cut-off blade structure includes a support holder. A blade is mounted within the support holder. A shaft is connected at one end to the support holder and is pivotally connected intermediate its other end to the support structure. A second lever is connected at its one end to the aforementioned other end of the shaft. The over-the-center spring arrangement is connected at its aforementioned one end to the aforementioned other end of the second lever.

BRIEF DESCRIPTION OF DRAWINGS

The details of my invention will be described in connection with the accompanying drawings in which.

BEST MODE FOR CARRYING OUT THE INVENTION

Figure 2:
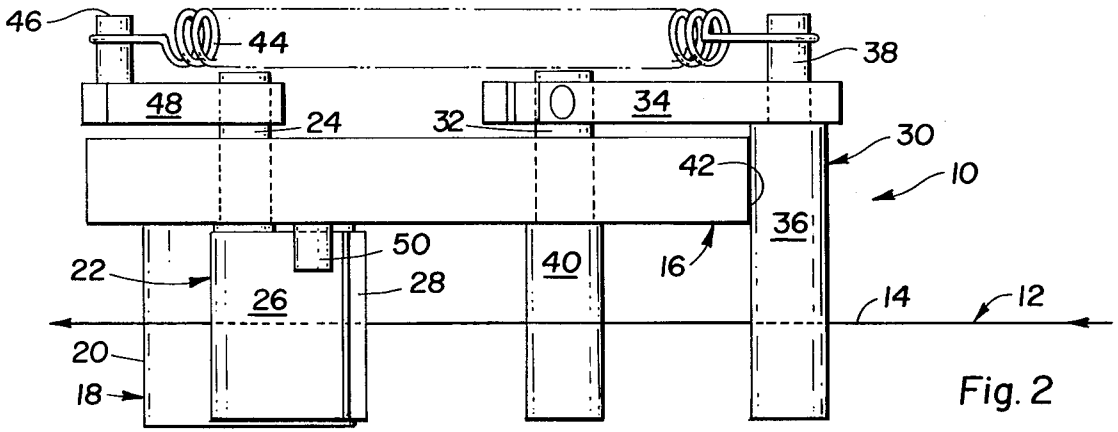
FIG. 2 is a plan view of the apparatus shown in FIG. 1.

In reference to the drawings, the rapid cut-off apparatus is shown at 10, which is intended to be positioned to one side of the path 12 of a high speed moving yarn 14 upstream of a yarn processing station 15, such as the high speed cutter shown in the aforementioned U.S. Pat. No. 4,519,281 illustrated in part at 15 in FIG. 1. The apparatus includes a support 16, which has an anvil 18 connected thereto and projecting from one of the faces of the support across the yarn path 14. The anvil is spaced from the path 12 of the yarn and provides a cutting surface 20 that is in alignment with the yarn 14 moving along the path. The anvil is circular in configuration and is adjustably rotatable so as to provide a cutting surface in unmarred condition.

A cut-off blade structure 22 is movably connected by a shaft 24 to the support 16, and includes a support holder 26 (FIG. 2) and a cut-off blade 28 mounted within the support holder. The cutting edge of the cut-off blade 26 and its support holder project from the support 16 across the yarn path 12 on the opposite side of the yarn path from the cutting surface 20 of the anvil 18. The cut-off blade structure is movably connected to the support 16 to move between an inoperative position (shown in FIG. 1 in solid lines) spaced from the yarn 14 and to an operative position (shown in FIG. 1 in phantom lines) in engagement of the cutting edge of the cut-off blade 26 against the cutting surface 20 of the anvil 18. The cut-off blade cutting edge frictionally engages the yarn and severs the yarn as it forces the yarn against the cutting surface of the anvil in the course of moving from the inoperative position toward the operative cut-off position of the cut-off blade structure 22.

A yarn guide arrangement 30 is movably connected to the support 16 by a shaft 32, and includes a first lever 34 through one end of which shaft 32 is connected, and at the other end of the first lever 34 a cylinder 36 is connected thereto by a shaft 38 extending through lever 34. The cylinder 36 extends from the face of the support 16 across the yarn path and defines a yarn guiding surface. A second cylinder 40 connected to one end of the shaft 32 also extends from the face of the support 16 across the yarn path and defines another yarn guiding surface.

The yarn guide arrangement is movably connected to the support 16 to move between an operative position (shown in FIG. 1 in solid lines) with both cylinders 36 and 40 extending across the path 12 of the yarn 14 for engaging and guiding the yarn toward the aforementioned yarn processing station 15 and to an inoperative non-yarn guiding position (shown in FIG. 1 in phantom lines) out of contact with the yarn. The yarn guide arrangement is located upstream along the yarn path from the anvil 18 and the cut-off blade structure 22.

Figure 1:
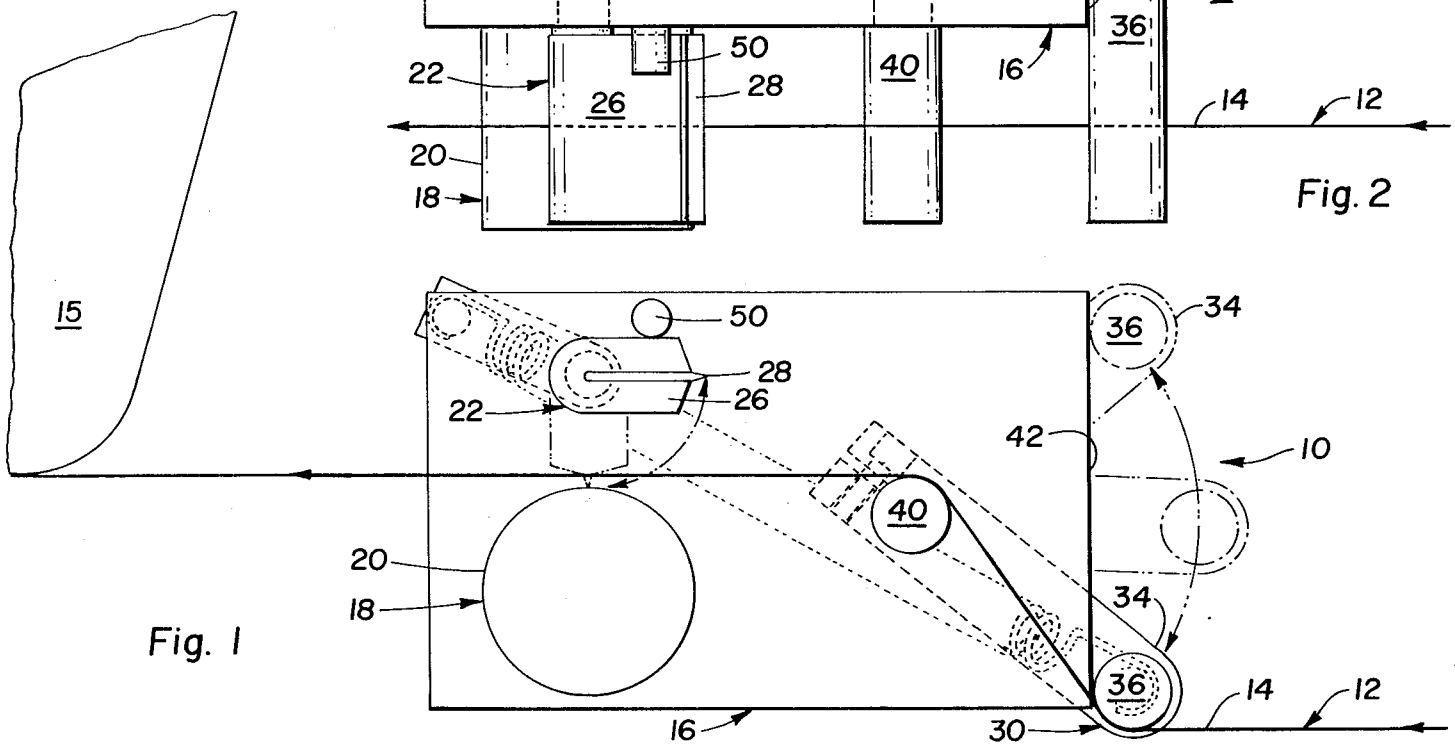
FIG. 1 is an elevational view of the rapid cut-off apparatus of the present invention.

As will be noted from the solid and phantom line positions in FIG. 1 of the yarn guide arrangement 30, the support 16 defines at two locations a stop surface 42 for each of the two positions (operative position and inoperative non-yarn guiding position) of the yarn guide arrangement with the cylinder 36 coming into abutment therewith at each location.

An over-the-center spring 44 (FIG. 2) having a predetermined tension is connected at its one end to the cut-off blade structure 22 through a shaft 46 extending from one end of a second lever 48. The other end of the second lever 48 is connected to shaft 24 leading to support holder 26 for the cut-off blade 28. The other end of the over-the-center spring is connected to the yarn guide arrangement 30. The over-the-center spring holds the cut-off blade structure in the inoperative position with the support holder 26 in abutment with a stop pin 50 projecting from the face of support 16.

The over-the-center spring arrangement is shiftable between (a) a first position for holding the cut-off blade structure 22 in an inoperative position and the yarn guide arrangement 30 in operative position (note the solid lines in FIG. 1) and (b) a second position for moving the cut-off blade structure 22 to the operative cut-off position (note the phantom lines in FIG. 1).

In operation, when tension upon the yarn 14 and from whatever cause suddenly exceeds the predetermined tension of the over-the-center spring arrangement 44, the yarn thereby forces the yarn guide arrangement 30 to move toward the aforementioned inoperative non-yarn guiding position (note phantom lines in FIG. 1). This causes the end of the over-the-center spring arrangement connected to the shaft 38 of the yarn guide arrangement to shift its position and when its length passes the center of the shaft 24 of the cut-off blade structure, the spring arrangement causes the cut-off blade structure 22 to move toward the operative yarn cut-off position. As the cutting edge of the cut-off blade 28 comes into frictional engagement with the yarn 14, the frictionally engaged yarn causes the pivoting movement of the cut-off blade to accelerate to the speed of the moving yarn. The pivoting blade forces the yarn against the cutting surface 20 of the anvil 18 and severs the yarn as the blade wedges the yarn against the anvil cutting surface.

Depending upon the material of which the cylinderical anvil 18 is made, the cutting edge of the cut-off blade 28 may or may not cause a nick to be cut into the cutting surface 20 of the anvil which might interfere with achieving a clean severage of the yarn. In order, therefore, to provide an unmarred cutting surface, the anvil is made so that it can be incrementally rotated to provide such unmarred surface, as earlier mentioned.

It should be understood that for purposes of preventing an operator or anyone else from inadvertently coming into contact with the cut-off blade a cover (not shown) would be provided for the apparatus with suitable openings for passage of the yarn therethrough.

The invention has been described in detail with particular reference to preferred embodiments thereof, but it will be understood that variations and modifications can be effected within the spirit and scope of the invention.

I claim:

1. Cut-off apparatus for rapidly cutting a yarn moving along a path therepast at high speed toward a yarn processing station when tension upon the yarn exceeds a predetermined tension, said cut-off apparatus comprising:

a support means positioned to one side of the path of the high speed moving yarn;

anvil means connected to said support means and projecting therefrom across said path and spaced from said yarn to provide a cutting surface in alignment with the yarn moving along said path;

cut-off blade means having a cutting edge projecting therefrom across said path on the opposite side of said path from the cutting surface of said anvil means, said cut-off blade means being movably connected to said support means between an inoperative position spaced from said yarn and an operative cut-off position in engagement of said cutting edge against said cutting surface of said anvil means, said cutting edge frictionally engaging said yarn and forcing it against said cutting surface of said anvil means to sever it in the course of moving from said inoperative position toward said operative cut-off position;

yarn guide means movably connected to said support means between an operative position extending across said path of said yarn for engaging and guiding said yarn toward said yarn processing station and to an inoperative non-yarn guiding position away from said path of said yarn, said yarn guide means being located upstream of said path of said yarn from said anvil means and said cut-off blade means; and over-the-center spring means having a predetermined tension and connected at one end to said cut-off blade means and connected at its other end to said yarn guide means, said spring means being shiftable between (a) a first position for holding said cut-off blade means in said inoperative position and said yarn guide means in said operative position and (b)

a second position for moving said cut-off blade means to said operative cut-off position, said yarn guide means being forced by said yarn in engagement therewith to said inoperative nonyarn guiding position upon tension on the yarn exceeding the predetermined tension of said spring means and thereby shifting said over-the-center spring means to said second position in the course of its movement to said inoperative non-yarn guiding position.

2. Cut-off apparatus as defined in claim 1 wherein said anvil means is circular in configuration and is adjustably rotatable to provide said cutting surface in unmarred condition.

3. Cut-off apparatus as defined in claim 1, wherein said yarn guide means includes a first lever pivotally connected at its one end to said support means, said first lever having extending from its other end a cylinder defining a yarn guiding surface, said support means defining a stop surface to be abutted by said cylinder when said yarn guide means is in said operative position.

4. Cut-off apparatus as defined in claim 1, wherein said cut-off blade means includes a support holder, a blade mounted within said support holder, a shaft connected at one end to said support holder and pivotally connected intermediate its other end to said support means, and a second lever connected at its one end to said other end of said shaft, said spring means being connected at its said one end to the other end of said second lever.

* * * * *